US005617741A

United States Patent [19]

McNeil et al.

[11] Patent Number: 5,617,741

[45] Date of Patent: Apr. 8, 1997

[54] DUAL COLUMN PROCESS TO REMOVE NITROGEN FROM NATURAL GAS

[75] Inventors: Brian A. McNeil, Chessington, United Kingdom; Michael H. Evans, Antwerpen, Belgium

[73] Assignee: Air Products and Chemicals, Inc., Allentown, Pa.

[21] Appl. No.: 597,414

[22] Filed: Feb. 8, 1996

[30] Foreign Application Priority Data

Feb. 10, 1995 [GB] United Kingdom ..... 9502657

[51] Int. Cl.[6] ..... F25J 3/02; F25J 3/08

[52] U.S. Cl. ..... 62/622; 62/927

[58] Field of Search ..... 62/620, 622, 927

[56] References Cited

U.S. PATENT DOCUMENTS

| | | | |
|---|---|---|---|
| 4,158,556 | 6/1979 | Yearout | 62/927 X |
| 4,415,345 | 11/1983 | Swallow . | |
| 4,451,275 | 5/1984 | Vines et al. | 62/927 X |
| 4,504,295 | 3/1985 | Davis et al. | 62/927 X |
| 4,559,070 | 12/1985 | Sweet | 62/927 X |
| 4,588,427 | 5/1986 | Yao et al. | 62/927 X |
| 4,664,686 | 5/1987 | Phahade et al. | 62/927 X |
| 4,710,212 | 12/1987 | Hanson et al. | 62/927 X |
| 4,805,413 | 2/1989 | Mitchell et al. | 62/927 X |
| 4,948,405 | 8/1990 | Thompson | 62/927 X |
| 5,257,505 | 11/1993 | Butts | 62/927 X |

FOREIGN PATENT DOCUMENTS

| | | | |
|---|---|---|---|
| 2131341 | 12/1972 | Germany | 62/927 |
| 2558903 | 7/1976 | Germany | 62/927 |
| 2208699 | 4/1989 | United Kingdom . | |

*Primary Examiner*—Christopher Kilner
*Attorney, Agent, or Firm*—John M. Fernbacher

[57] ABSTRACT

Nitrogen is removed from a natural gas feed stream by a cryogenic distillation process in which said feed stream is fed to a primary column of a distillation column system having a primary column and a secondary column fed from and operating at substantially the same pressure as the primary column. At least a portion of a primary column methane-rich bottoms liquid is expanded and at least partially vaporized in heat exchange with a condensing primary column nitrogen-enriched vapor. The at least partially condensed primary column nitrogen-enriched vapor is returned to the primary column to provide higher temperature reflux to the distillation column system. A secondary column methane-rich bottoms liquid is at least partially vaporized in heat exchange with a condensing nitrogen-rich overhead vapor to produce a further methane-rich product. At least a portion of the at least partially condensed nitrogen-rich overhead vapor portion is returned to the primary or secondary column to provide lower temperature reflux to the distillation column system.

26 Claims, 3 Drawing Sheets

DUAL COLUMN PROCESS TO REMOVE NITROGEN FROM NATURAL GAS

FIELD OF THE INVENTION

The present invention relates to a cryogenic process for the removal of nitrogen from feed gas comprising nitrogen and hydrocarbons.

BACKGROUND OF THE INVENTION

The increasing use of natural gas as a fuel has resulted in a need to remove nitrogen from some natural gas sources, in order to meet Wobbe Index and calorific value specifications, particularly where the gas is delivered into a country's gas transmission system. The nitrogen may either be naturally occurring or resulting from nitrogen injection into oil fields for enhanced recovery.

A particular problem is to design a process for efficient removal of nitrogen from natural gas feed at high pressure (75 to 130 bar absolute; 7.5 to 13 MPa), with relatively small concentrations of nitrogen (5 to 15 mol %), and to produce sales gas at a pressure similar to the feed gas pressure.

A further problem is that, as gas reservoir pressure decays to below the required sales gas pressure (e.g., about 75 bar absolute (7.5 MPa) in the case of the United Kingdom's National Transmission System), feed gas compression needs to be added. This is a relatively expensive investment since it is not utilized fully throughout the life of the nitrogen removal unit (NRU).

Therefore, an object of the present invention is to provide an improved process to remove nitrogen from natural gas feed with low nitrogen content (5 to 15 mol %) and at high pressure (75 to 130 bar absolute; 7.5 to 13 MPa). It is a further object of this invention to provide a process for removal of nitrogen from natural gas feed, which is sufficiently flexible to operate at lower feed pressure (25 to 75 bar absolute; 2.5 to 7.5 MPa) while still producing sales gas at higher pressure (about 75 bar absolute; 7.5 MPa), without the need for feed gas compression.

Nitrogen removal from natural gas is usually most economically effected by cryogenic distillation. Numerous cycles have been developed, many based on the concept of double distillation columns as used in air separation. One problem associated with double column cycles is that, at feed nitrogen concentrations less than 25 mol %, the quantity of reflux liquid that can be generated is insufficient to achieve an economic recovery of methane. Another problem is that relatively low concentrations of carbon dioxide and hydrocarbons, such as benzene, hexane and heavier components, would freeze at the cryogenic temperatures associated with the lower pressure column.

GB-B-2,208,699 describes an improved process that is less energy intensive at low levels of feed nitrogen concentration, in which the separation is effected in two columns with integrated condensation of overhead first column vapor and second column reboil. While this process overcomes the problems mentioned above, it is relatively complicated and expensive.

U.S. Pat. No. 4,415,345 discloses the removal of nitrogen from a natural gas feed stream by a cryogenic process using primary and secondary distillation columns operating at different pressures. Primary column methane-rich bottoms liquid is cooled by heat exchange against secondary column bottoms liquid and secondary column nitrogen-rich nitrogen overhead and then expanded prior to feeding to the secondary column. Primary column nitrogen overhead provides reboil to the secondary column and is returned to the primary column and/or secondary column as reflux.

SUMMARY OF THE INVENTION

In the present invention nitrogen is removed from a natural gas feed stream by a cryogenic distillation process in which said feed stream is fed to a primary column of a distillation column system having a primary column and a secondary column fed from and operating at substantially the same pressure as the primary column. At least a portion of a primary column methane-rich bottoms liquid is expanded and at least partially vaporized in heat exchange with a condensing primary column nitrogen-enriched vapor. The at least partially condensed primary column nitrogen-enriched vapor is returned to the primary column to provide higher temperature reflux to the distillation column system. A secondary column methane-rich bottoms liquid is at least partially vaporized in heat exchange with a condensing nitrogen-rich overhead vapor to produce a further methane-rich product. At least a portion of the at least partially condensed nitrogen-rich overhead vapor portion is returned to the primary or secondary column to provide lower temperature reflux to the distillation column system.

Preferably, the primary column provides the nitrogen-rich overhead vapor and a primary column nitrogen-enriched liquid at an intermediate location above the primary column nitrogen-enriched vapor. The primary column nitrogen-enriched liquid is fed to the secondary column and a secondary column nitrogen-rich overhead vapor is fed to the primary column, preferably after at least partial condensation to provide intermediate reflux.

DETAILED DESCRIPTION OF THE INVENTION

Figure 1:
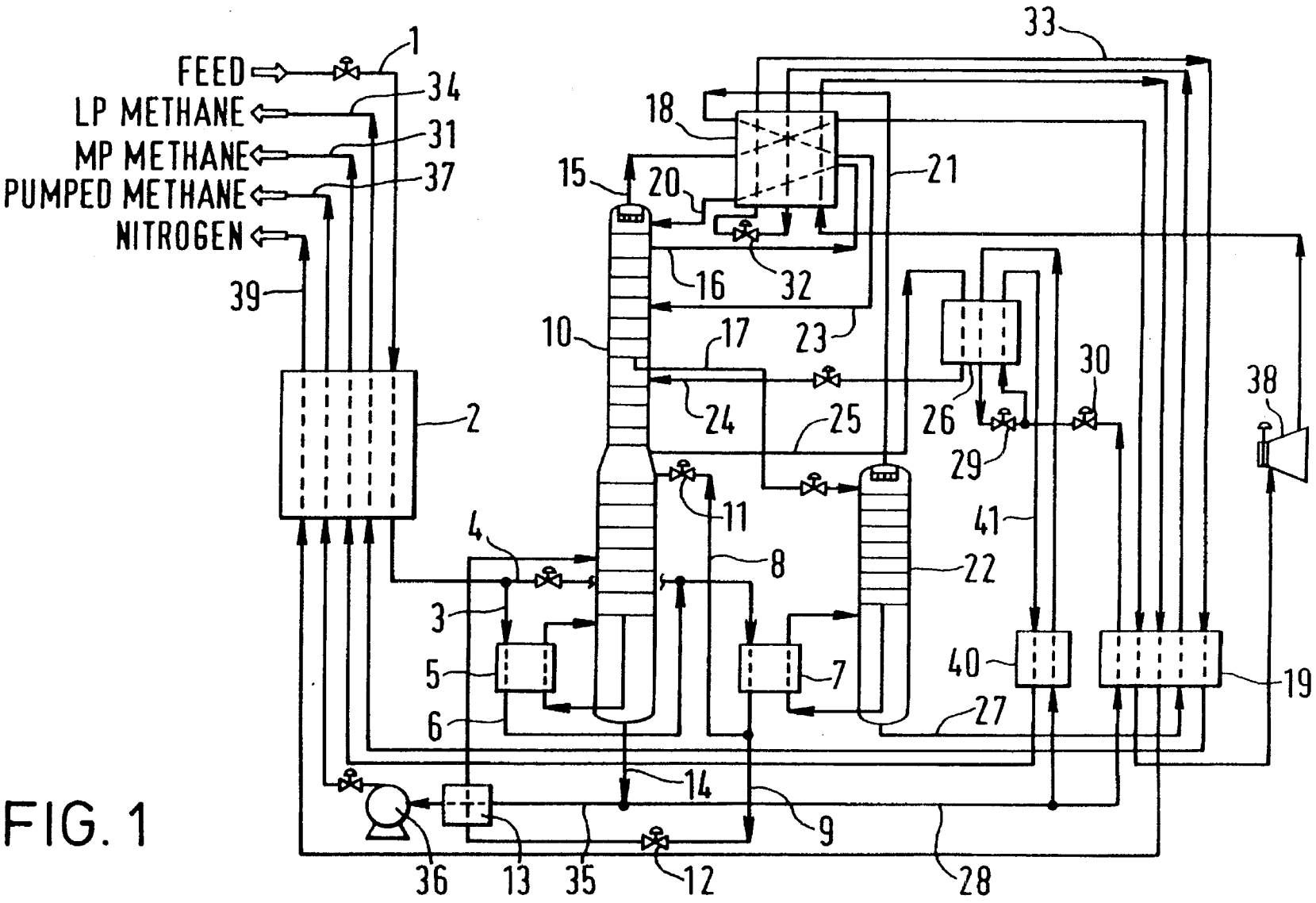
FIG. 1 is a schematic diagram of the process in accordance with one embodiment of the present invention.

The present invention provides a cryogenic process for the removal of nitrogen from a natural gas feed stream comprising nitrogen and hydrocarbons primarily having a carbon content between 1 and 8 carbon atoms comprising:

(A) feeding said feed stream to a primary distillation column of a distillation column system, said system providing a primary column methane-rich bottoms liquid from the primary column, a secondary column methane-rich bottoms liquid from a secondary distillation column fed from and operating at substantially the same pressure as the primary column, a primary column nitrogen-enriched vapor from the primary column, and a nitrogen-rich overhead vapor;

(B) reducing the pressure of and at least partially vaporizing at least a portion of the primary column methane-rich bottoms liquid in heat exchange with at least a portion of the primary column nitrogen-enriched vapor to produce a methane-rich product and to at least partially condense the primary column nitrogen-enriched vapor;

(C) returning at least a portion of the at least partially condensed primary column nitrogen-enriched vapor to the primary column to provide higher temperature reflux to the distillation column system;

(D) reducing the pressure of and at least partially vaporizing at least a portion of the secondary column methane-rich bottoms liquid in heat exchange with at least a portion of the nitrogen-rich overhead vapor to produce a further methane-rich product and to at least partially condense said nitrogen-rich overhead vapor portion; and (E) returning at least a portion of the at least partially condensed nitrogen-rich overhead vapor portion to the primary or secondary column to provide lower temperature reflux to the distillation column system.

The invention also provides an apparatus for the cryogenic removal of nitrogen from a natural gas feed stream by said process of the invention, the apparatus comprising:

a distillation system having a primary distillation column and a secondary distillation column fed from and operating at substantially the same pressure as the primary column, said system providing a primary column methane-rich bottoms liquid from the primary column, a secondary column methane-rich bottoms liquid from the secondary distillation column, a primary column nitrogen-enriched vapor, and a nitrogen-rich overhead vapor;

means for feeding the feed stream to the primary distillation column, means for reducing the pressure of and at least partially vaporizing at least a portion of the primary column methane-rich bottoms liquid in heat exchange with at least a portion of the primary column nitrogen-enriched vapor to produce a methane-rich product and to at least partially condense the primary column nitrogen-enriched vapor;

means for returning at least a portion of the at least partially condensed primary column nitrogen-enriched vapor to the primary column to provide higher temperature reflux to the distillation column system;

means for at least partially vaporizing at least a portion of the secondary column methane-rich bottoms liquid in heat exchange with at least a portion of the nitrogen-rich overhead vapor to produce a further methane-rich product and to at least partially condense the nitrogen-rich overhead vapor portion; and means for returning at least a portion of the at least partially condensed nitrogen-rich overhead vapor portion to the primary or secondary column to provide lower temperature reflux to the distillation column system.

In a first, presently preferred, embodiment, the primary column provides the primary column methane-rich bottoms liquid, the primary column nitrogen-enriched vapor, the nitrogen-rich overhead vapor, and a primary column nitrogen-enriched liquid at an intermediate location above the primary column feed; the primary column nitrogen-enriched liquid is separated in the secondary column providing the secondary column methane-rich bottoms liquid and a secondary column nitrogen-rich overhead vapor; the secondary column nitrogen-rich overhead vapor is fed to the primary column; and the lower temperature reflux is provided to the primary column.

Usually, the secondary column nitrogen-rich overhead vapor is at least partially condensed prior to feeding to the primary column to provide intermediate temperature reflux to the distillation column system. Suitably, this condensation is effected by heat exchange with at least a portion of the secondary column methane-rich bottoms liquid; with at least a portion of the nitrogen-rich overhead vapor from the primary column; or, preferably, with both the secondary column methane-rich bottoms liquid and at least a portion of the nitrogen-rich overhead vapor from the primary column.

At least a portion of the primary column nitrogen-rich overhead vapor can be warmed and then expanded to recover further refrigeration.

The portion of the primary column above the location for removing the primary column nitrogen-enriched liquid and the heat exchanger condensing at least a portion of the primary column nitrogen-rich overhead vapor can be constituted by a dephlegmator.

In a preferred process of the first embodiment:

(a) the natural gas feed stream is cooled and at least partially condensed;

(b) the pressure of the natural gas feed stream is reduced and this reduced pressure, natural gas feed stream fed to an intermediate location of the primary column;

(c) the primary column methane-rich bottoms liquid is removed from the primary column and divided into first and second portions;

(d) said first portion is pumped to increase its pressure, vaporized, and recovered as a first methane-rich product;

(e) said second portion is subcooled, reduced in pressure, and at least partially vaporized to produce a second methane-rich product;

(f) a first portion of the primary column nitrogen-rich overhead vapor is warmed to recover refrigeration;

(g) a second portion of the primary column nitrogen-rich overhead vapor is at least partially condensed and returned to the top of the primary column to provide reflux;

(h) the primary column nitrogen-enriched liquid is removed from an upper intermediate location of the primary column, and fed to the top of the secondary column;

(i) the secondary column nitrogen-rich overhead vapor is at least partially condensed and fed to an upper portion of the primary column;

(j) the secondary column methane-rich bottoms liquid is removed, subcooled, reduced in pressure, vaporized and recovered as a tertiary gas product;

(k) at least a part of the refrigeration recovered in warming the primary column nitrogen-rich overhead vapor first portion of step (f) and in vaporizing the secondary column methane-rich bottoms liquid of step (j) is used to condense the primary column nitrogen-rich overhead vapor second portion of step (g) to provide reflux to the top of the primary column; and (l) the primary column nitrogen-enriched vapor is removed from the primary column between the feed point of step (b) and the upper intermediate location of step (h) and at least partially condensed by heat exchange against the subcooled, reduced pressure second portion of the primary column methane-rich bottoms liquid to provide higher temperature reflux.

In a second embodiment, the primary column provides the primary column methane-rich bottoms liquid and the primary column nitrogen-enriched vapor; at least a portion of the primary column nitrogen-enriched vapor is separated in the secondary column providing the secondary column methane-rich bottoms liquid and the nitrogen-rich overhead vapor; and the lower temperature reflux is provided to the secondary column.

In this embodiment, the primary column nitrogen-enriched vapor usually will be at least partially condensed before being fed to the secondary column. The primary column nitrogen-enriched vapor can be withdrawn as overhead from the primary column to provide the only feed to the secondary column. Alternatively, it can be withdrawn from an intermediate location of the primary column and a primary column nitrogen-enriched overhead vapor also withdrawn and fed to the secondary column.

Also in this embodiment, the portion of the secondary column located above the nitrogen-enriched feed and the heat exchanger condensing at least a portion of the nitrogen-rich overhead vapor can be constituted by a dephlegmator.

Referring generally to the invention, it is preferred that, prior to heat exchange with the primary column nitrogen-enriched vapor, the primary column methane-rich bottoms liquid advantageously is subcooled.

Preferably, the primary column methane-rich bottoms liquid is divided into first and second portions; said first portion is recovered as a methane-rich product; and said second portion is reduced in pressure and at least partially vaporized in heat exchange with the nitrogen-enriched vapor. Usually, the pressure of the first portion of the primary column methane-rich bottoms liquid will be increased prior to recovery and, optionally, at least partially vaporized before recovery as methane-rich product.

It is advantageous for the secondary column methane-rich bottoms liquid to be subcooled and reduced in pressure prior to the heat exchange with the nitrogen-rich overhead vapor.

Advantageously, the primary and secondary columns are reboiled by heat exchange with the natural gas feed stream.

It also is preferred that the natural gas feed stream is expanded in a dense fluid expander prior to feeding to the primary column.

Preferably, the natural gas feed stream is divided into first and second portions; said first portion is reduced in pressure and then fed to an intermediate location of the primary column; and said second portion is reduced in pressure, partially vaporized and then fed to the primary column at a location below the feed point of the first feed portion.

If required a further nitrogen-enriched vapor from an upper location of the primary column can be condensed and returned to the primary column as an intermediate temperature reflux.

An intermediate reboiler/condenser can be located in the primary column below the feed point of the natural gas feed stream or in the secondary column below the feed point to the column.

Referring to FIG. 1, a natural gas feed in line 1, which has been treated to reduce to acceptable concentrations freezing components such as water and carbon dioxide, is cooled and at least partially condensed in main heat exchanger 2, and then split into two portions in lines 3 and 4. The feed gas will generally contain 5 to 15 mol % nitrogen and will be at a pressure of 25 to 130 bar absolute (2.5 to 13 MPa), preferably 60 to 80 bar absolute (6 to 8 MPa). The first feed portion (in line 3) is further cooled and condensed (if not completely condensed in main heat exchanger 2) in primary column reboiler 5. The second feed portion (in line 4) bypasses reboiler 5 and recombines with the condensed feed in line 6 from reboiler 5 before being further cooled in secondary column reboiler 7. Following such further cooling, the stream is further divided into two parts in lines 8 and 9. The major and first part (in line 8), is then fed to primary distillation column 10 after being reduced in pressure by valve 11. A smaller second part (in line 9) is flashed across valve 12, and partially vaporized in subcooler 13 before also being introduced to primary distillation column 10.

Primary distillation column 10 operates at a pressure from 10 to 30 bar absolute (1 to 3 MPa), preferably between 20 and 28 bar absolute (2 and 2.8 MPa), and provides a methane-rich bottom liquid stream in line 14, nitrogen-rich overhead vapor streams in lines 15 and 16, and an intermediate liquid stream in line 17. The nitrogen-rich overhead vapor stream typically contains 2 mol % methane, and the methane-rich bottom liquid stream has a typical nitrogen concentration of 0.5 mol %. This is generally lower than the required nitrogen content of natural gas that is delivered, for example, to the United Kingdom's National Transmission System (NTS), where concentrations of 4 to 5 mol % are acceptable in gas with parts per million concentrations of carbon dioxide. By reducing the nitrogen content to this low level, which is perfectly feasible in a cryogenic NRU, the quantity of feed gas that must be processed is reduced, the final sales gas product being blended from feed gas bypass and NRU product. The UK's NTS specification allows up to 2 mol % $CO_2$, and, with increasing $CO_2$ content, nitrogen would need to be removed to a lower concentration in the sales gas by processing more gas in the NRU.

The reboil duty for column 10 is provided by heat exchange with the feed stream cooling in reboiler 5.

The nitrogen-rich overhead vapor in line 15 from the top of column 10 containing about 2 mol % methane is warmed in condenser 18 and subcooler 19. Condenser 18 provides reflux liquid for the top two sections of column 10 by partly condensing nitrogen-rich overhead vapor in line 16 and returning the condensed liquid in line 20 to the top stage of column 10 and condensing vapor in line 21 from the top of secondary column 22 and returning this liquid in line 23 to a lower stage of column 10. A substantial amount of reflux liquid is provided via line 24 at an intermediate stage below the top two sections of column 10 by at least partly condensing, in condenser 26, a vapor side stream withdrawn via line 25 from column 10. This side stream is withdrawn at or above the feed entry location and returned as reflux liquid several equilibrium stages above the withdrawal point. This reflux philosophy is much more efficient than a process that provides all of the column reflux liquid at the top of column 10, since the majority of the refrigeration required to condense the reflux is provided at the warmer condensing temperatures of the side stream in line 25 from column 10 and the vapor in line 21 from secondary column 22.

The intermediate liquid stream in line 17 is withdrawn from column 10 at a higher stage than the feed of natural gas to the column and fed to the top of secondary column 22. Secondary column 22 operates at a similar pressure to column 10 and separates the feed into a second methane-rich bottom liquid stream in line 27, with a typical nitrogen concentration of 0.5 mol %, and a nitrogen-enriched overhead vapor stream in line 21.

The bottom liquid stream in line 27 from column 22 has very low concentrations of carbon dioxide and hydrocarbons heavier than methane because the liquid feed in line 17 to secondary column 22 is taken from above the feed entry stage of column 10. Most of the carbon dioxide and heavy hydrocarbons are recovered in the bottom liquid stream in line 14 from column 10.

The reboil duty for secondary column 22 is provided by heat exchange with the feed stream cooling in reboiler 7.

Part 28 of the methane-rich bottom liquid stream in line 14 from column 10 is subcooled in subcooler 40 and condenser 26 or in subcooler 19, then at least partly vaporized by heat exchange in condenser 26 after pressure reduction across valves 29 and 30. It is then fed via line 41 to be further vaporized and warmed in subcooler 40 and main heat exchanger 2 to be delivered via line 31 as part of the sales gas product.

The methane-rich bottom liquid stream in line 27 from secondary column 22 is subcooled in subcooler 19 and condenser 18, then vaporized and warmed by heat exchange in condenser 18 after pressure reduction across valve 32. It is then fed via line 33 for further warming in subcooler 19 and main heat exchanger 2 to be delivered via line 34 as another part of the sales gas product.

The two methane streams 31 & 34 are compressed to the required sales gas product pressure.

The evaporating temperature of the methane in condenser 26 is sufficiently high that freezing of carbon dioxide and heavy hydrocarbons does not occur, while the methane that vaporizes at a lower temperature in condenser 18 is substantially free of freezing components.

The remaining liquid in line 14 from the bottom of column 10 is fed via line 35 for subcooling in subcooler 13 before being pumped in pump 36. Subcooler 13 minimizes the elevation of the column 10 above the pump 36 required to provide the necessary net positive suction head (NPSH) at the pump suction, particularly if there is a large turndown requirement where heat leak into the pump suction piping could cause cavitation at turndown. The pumped liquid is then vaporized and warmed in main heat exchanger 2 and delivered via line 37 to be mixed with the compressed methane and delivered as sales gas product at a pressure of 25 to 130 bar absolute (2.5 to 13 MPa), preferably 60 to 80 bar absolute (6 to 8 MPa).

After warming in condenser 18 and subcooler 19, the nitrogen-rich overhead vapor in line 15 from column 10 is expanded in expander 38 and provides additional refrigeration to condenser 18 and subcooler 19. This is then warmed in main heat exchanger 2 and vented to atmosphere via line 39. Environmental constraints will generally limit the methane content in vented nitrogen to 2 mol % maximum. The process is capable of achieving much lower methane content, if required, by increasing the quantity of reflux liquid for the top of column 10. Some of the nitrogen-rich vent stream may be used as utility nitrogen for purposes such as cold box purge and adsorber regeneration.

The process achieves a very high methane recovery, typically about 99.8%, since the methane content in the vent nitrogen can be reduced to less than 2 mol %.

Table 1 summarizes a mass balance for a typical application of this invention.

TABLE 1

| | | Stream | | | | | | |
|---|---|---|---|---|---|---|---|---|
| | | 1 | 8 | 35 | 37 | 41 | 31 | 27 |
| Pressure | bar abs | 78.3 | 73.5 | 24.4 | 79.4 | 8.9 | 8.3 | 24.3 |
| | kPa | 7,830 | 7,350 | 2,440 | 7,940 | 890 | 830 | 2,430 |
| Temperature | deg C. | 30 | −102 | −101 | 24 | −112 | 24 | −103 |
| Flowrate | kg-mol/h | 100 | 98.74 | 59.64 | 59.64 | 26.51 | 26.51 | 5.48 |
| Vapor Fraction | mol/mol | 1 | 0 | 0 | 1 | 0.936 | 1 | 0 |
| Composition | | | | | | | | |
| Hydrogen | mol % | 0.052 | 0.052 | | | | | |
| Helium | mol % | 0.031 | 0.031 | | | | | |
| Nitrogen | mol % | 8.582 | 8.582 | 0.5 | 0.5 | 0.5 | 0.5 | 0.5 |
| Carbon dioxide | mol % | 0.005 | 0.005 | 0.006 | 0.006 | 0.006 | 0.006 | |
| Methane | mol % | 87.487 | 87.487 | 95.034 | 95.034 | 95.034 | 95.034 | 99.499 |
| Ethane | mol % | 2.847 | 2.847 | 3.305 | 3.305 | 3.305 | 3.305 | 0.001 |
| Propane | mol % | 0.618 | 0.618 | 0.717 | 0.717 | 0.717 | 0.717 | |
| Butanes | mol % | 0.314 | 0.314 | 0.364 | 0.364 | 0.364 | 0.364 | |
| Pentanes | mol % | 0.051 | 0.051 | 0.059 | 0.509 | 0.059 | 0.059 | |
| n-Hexane | mol % | 0.011 | 0.011 | 0.013 | 0.013 | 0.013 | 0.013 | |
| n-Heptane | mol % | 0.002 | 0.002 | 0.002 | 0.002 | 0.002 | 0.002 | |

| | | Stream | | | | | | | |
|---|---|---|---|---|---|---|---|---|---|
| | | 33 | 34 | 15 | 39 | 25 | 24 | 21 | 23 |
| Pressure | bar abs | 1.8 | 1.6 | 24.1 | 1.2 | 24.3 | 24.3 | 24.2 | 24.2 |
| | kPa | 180 | 160 | 2,410 | 120 | 2,430 | 2,430 | 2,420 | 2,420 |
| Temperature | deg C. | −125 | 24 | −153 | 24 | −111 | −125 | −124 | −142 |
| Flowrate | kg-mol/h | 5.48 | 5.48 | 8.37 | 8.37 | 32.68 | 32.68 | 3.62 | 3.62 |
| Vapor Fraction | mol/mol | 1 | 1 | 1 | 1 | 1 | 0.075 | 1 | 0 |
| Composition | | | | | | | | | |
| Hydrogen | mol % | | | 0.62 | 0.62 | 0.118 | 0.118 | 0.063 | 0.063 |
| Helium | mol % | | | 0.37 | 0.37 | 0.068 | 0.068 | 0.013 | 0.013 |
| Nitrogen | mol % | 0.5 | 0.5 | 97.01 | 97.01 | 24.378 | 24.378 | 55.367 | 55.367 |
| Carbon dioxide | mol % | | | | | | | | |
| Methane | mol % | 99.499 | 99.499 | 2.0 | 2.0 | 75.422 | 75.422 | 44.557 | 44.557 |
| Ethane | mol % | 0.001 | 0.001 | | | 0.014 | 0.014 | | |
| Propane | mol % | | | | | | | | |
| Butanes | mol % | | | | | | | | |
| Pentanes | mol % | | | | | | | | |
| n-Hexane | mol % | | | | | | | | |
| n-Heptane | mol % | | | | | | | | |

Figure 2:
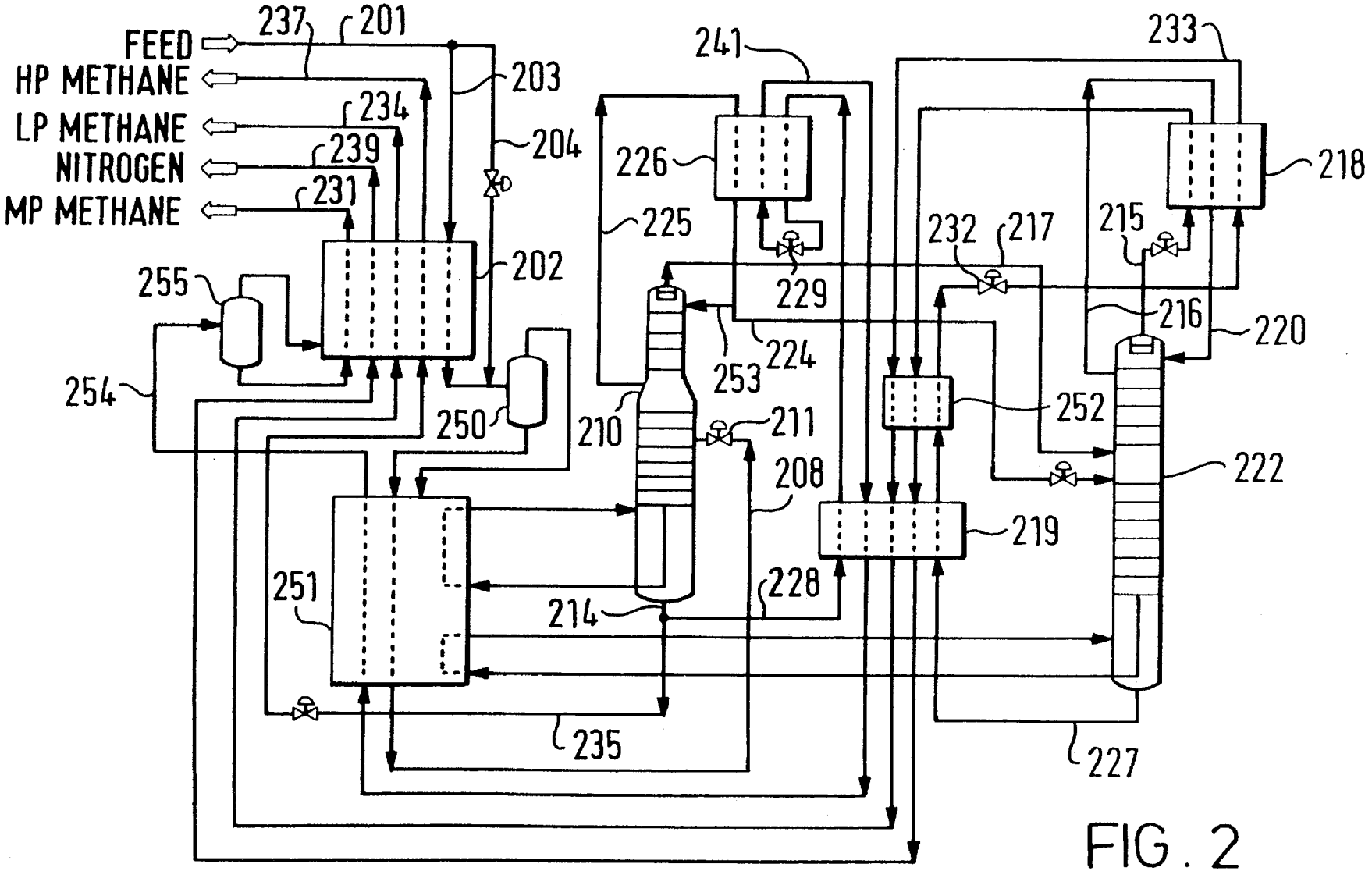
FIG. 2 is a schematic diagram of the process in accordance with another embodiment of the present invention.

In FIG. 2, those items which are the same or similar to items of the embodiment of FIG. 1 are identified with corresponding reference numerals in the 200 series.

Referring to FIG. 2, a natural gas feed in line 201, which has been treated to reduce to acceptable concentrations freezing components such as water and carbon dioxide, is split into two portions in lines 203 and 204. The feed gas will generally contain 5 to 15 mol % nitrogen and will be at a pressure of 25 to 130 bar absolute (2.5 to 13 MPa), preferably 60 to 80 bar absolute (6 to 8 MPa). The feed portion in line 203 is cooled and at least partially condensed in main heat exchanger 202, and then fed to phase separator 250. The feed portion in line 204 is reduced in pressure across a valve to compensate for the pressure loss in feed portion 203 as it passes through the main heat exchanger and then also fed to the phase separator 250. Condensate and gas from phase separator 250 are combined and cooled in heat exchanger 251, where the feed is further condensed. The further condensed feed is then fed to primary distillation column 210 after being reduced in pressure by valve 211.

Primary distillation column 210 operates at a pressure from 10 to 30 bar absolute (1 to 3 MPa), preferably between 20 and 28 bar absolute (2 and 2.8 MPa), and provides a methane-rich bottom liquid stream in line 214, a nitrogen-enriched overhead vapor stream in line 217, and an intermediate nitrogen-enriched vapor stream in line 225.

The reboil duty for column 210 is provided by heat exchange with the feed stream cooling in heat exchanger 251.

The nitrogen-enriched overhead vapor in line 217 is fed to secondary column 222. Secondary column 222 operates at a similar pressure to column 210 and separates the feed into a second methane-rich bottom liquid stream in line 227, with a typical nitrogen concentration of 0.5 mol %, and nitrogen-rich overhead vapor streams in lines 216 and 215. The bottom liquid stream in line 227 from column 222 has very low concentrations of carbon dioxide and hydrocarbons heavier than methane because the feed in line 217 to secondary column 222 is taken from the top of column 210. Most of the carbon dioxide and heavy hydrocarbons are recovered in the bottom liquid stream in line 214 from column 210.

The reboil duty for secondary column 222 is provided by heat exchange with the feed stream cooling in heat exchanger 251.

The nitrogen-rich overhead vapor in line 215 from the top of column 222 containing about 2 mol % methane is warmed in condenser 218 and subcoolers 252 and 219. Condenser 218 provides reflux liquid for the top of column 222 by partly condensing nitrogen-rich overhead vapor in line 216 from the top of column 222 and returning the condensed liquid in line 220 to the column 222. Additional liquid feed is provided via line 224 at an intermediate stage of column 222 by at least partly condensing, in condenser 226, the vapor side stream withdrawn via line 225 from column 210. This side stream is withdrawn at or above the feed entry location and a portion of the condensed stream is returned via line 253 to provide reflux to column 210. The pressure of the liquid feed from line 224 is reduced slightly across a control valve immediately prior to feeding to the secondary column 222 but the secondary and primary columns operate at substantially the same pressure.

Part 228 of the methane-rich bottom liquid stream in line 214 from column 210 is subcooled in subcooler 219 and condenser 226 and then at least partly vaporized by heat exchange in condenser 226 after pressure reduction across valve 229. It is then fed via line 241 to be further vaporized and warmed in subcooler 219 and heat exchanger 251. The partially vaporized stream 254 from heat exchanger 251 is fed to phase separator 255, the separated liquid and vapor portions combined and further warmed in the main heat exchanger 202 and delivered via line 231 as part of the sales gas product.

The methane-rich bottom liquid stream in line 227 from secondary column 222 is subcooled in subcoolers 219 and 252, then vaporized and warmed by heat exchange in condenser 218 after pressure reduction across valve 232. It is then fed via line 233 for further warming in subcoolers 252 and 219 and main heat exchanger 202 to be delivered via line 234 as another part of the sales gas product.

The evaporating temperature of the methane in condenser 226 is sufficiently high that freezing of carbon dioxide and heavy hydrocarbons does not occur, while the methane that vaporizes at a lower temperature in condenser 218 is substantially free of freezing components.

The remaining liquid in line 214 from the bottom of column 210 is fed via line 235 to be vaporized and warmed in main heat exchanger 202 after some reduction in pressure across a valve and then delivered via line 237 as another part of the sales gas product.

The three methane streams 231, 234, & 237 are compressed to the required sales gas product pressure.

After warming in condenser 218 and subcoolers 252 and 219, the nitrogen-rich overhead vapor in line 215 from column 222 is further warmed in main heat exchanger 202 and vented to atmosphere via line 239. Environmental constraints will generally limit the methane content in vented nitrogen to 2 mol % maximum. The process is capable of achieving much lower methane content, if required, by increasing the quantity of reflux liquid for the top of column 222. Some of the nitrogen-rich vent stream may be used as utility nitrogen for purposes such as cold box purge and adsorber regeneration.

Figure 3:
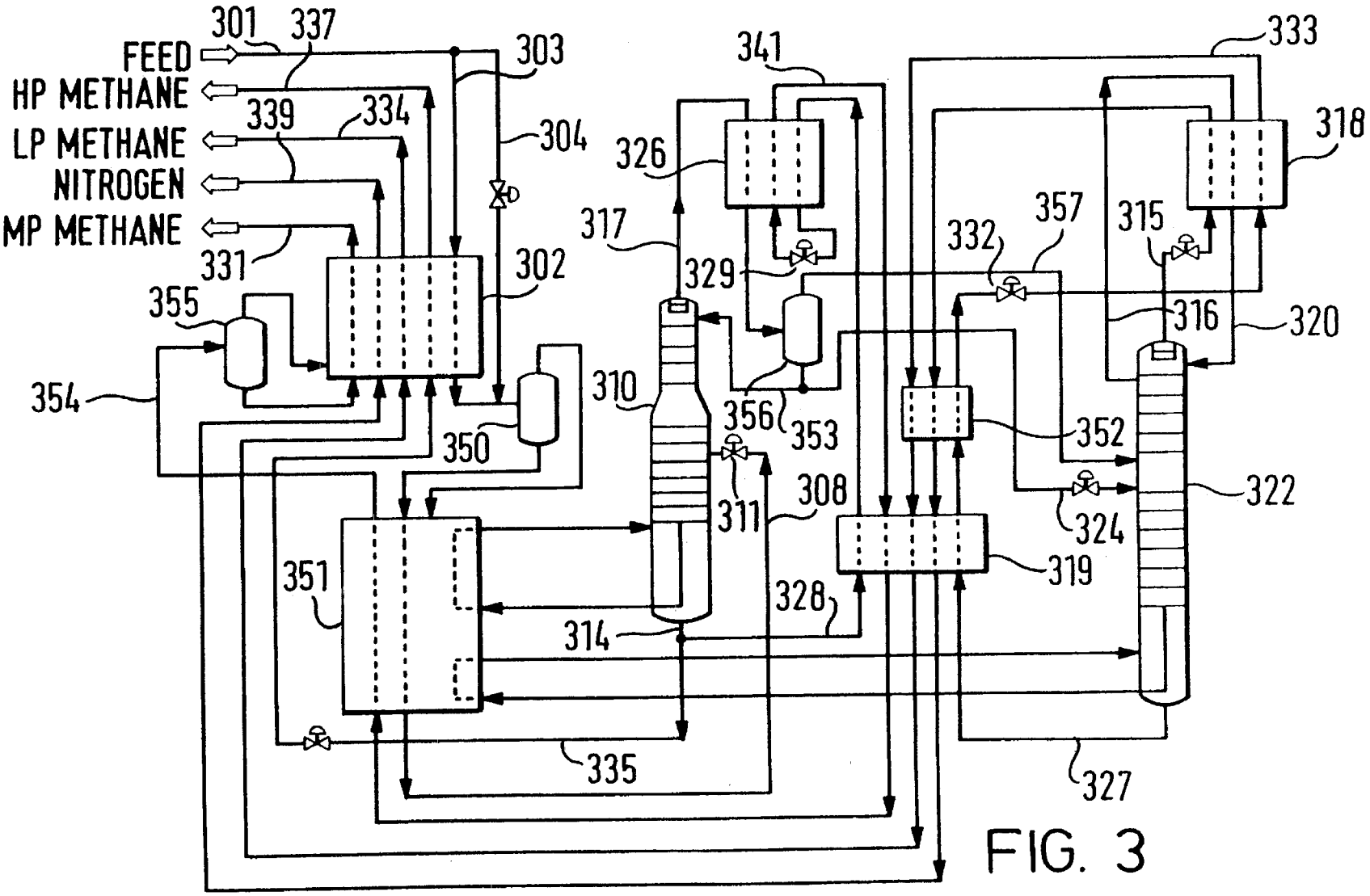
FIG. 3 is a schematic diagram of the process in accordance with a further embodiment of the present invention.

In FIG. 3, those items which are the same or similar to items of the embodiment of FIG. 2 are identified with corresponding reference numerals in the 300 series.

Having regard to the similarity between the embodiments of FIGS. 2 and 3, only the differences between embodiment of FIG. 3 and that of FIG. 2 will be described.

In the embodiment of FIG. 3, there is no intermediate nitrogen-enriched vapor stream corresponding to that in line 225 of FIG. 2 but instead the nitrogen-enriched overhead vapor stream 317 is partially condensed in the condenser 326. The partially condensed stream is separated in phase separator 356 into vapor, which is fed to the secondary column 322 via line 357, and liquid, which provides reflux to the primary column 310 and feed to the secondary column 322 via lines 353 and 324 respectively.

Several modifications of the above-described process are possible within the scope of the invention, including (with reference to the embodiment of FIG. 1; corresponding modifications being possible as appropriate to the embodiments of FIGS. 2 and 3):

Omitting the reflux 23 and feeding the secondary column nitrogen-rich overhead vapor 21 directly to the primary column at substantially the same position as withdrawal of the nitrogen-enriched liquid feed 17.

Replacing the two nitrogen-rich overhead vapor streams 15 & 16 with a single stream and returning to the primary column an at least partially condensed portion of the stream.

Refrigeration for column reflux liquid could be provided by evaporating methane-rich liquid from columns 10 and/or 22 at additional pressure levels if the resulting reduction in power consumption warranted the extra complexity.

Part, or all, of the nitrogen removed from the natural gas can be recovered as a by-product at higher pressure by increasing expander 38 outlet pressure or by expanding part, or none, of the nitrogen stream and warming the remainder separately in main heat exchanger 2. This may result in the elimination of expander 38 from the process. It is possible to eliminate expander 38 in any event by increasing the refrigeration produced by the methane-rich liquid streams evaporating in condensers 26 and 18, although this is less efficient.

Expander 38 could be moved to provide refrigeration at a warmer part of the process, e.g., around exchanger 2. This could be beneficial where the feed pressure was much lower than the required sales gas product pressure.

It is possible to improve the process efficiency by expanding the feed to column 10 in a dense fluid expander, rather than valve 11. The expansion work could be recovered in a suitable device, such as an electricity generator, and the refrigeration produced would reduce the refrigeration required from the methane-rich streams evaporating in condensers 26 and 18.

Subcooler 13 could be eliminated and the required pump NPSH developed by increasing the elevation difference between the column 10 sump and the pump 36 suction.

Part, or all, of the feed expanded in valve 11 could be subcooled to a lower temperature in subcooler 40 prior to pressure reduction and introduction to primary distillation column 10.

The column system could be modified to include intermediate reboilers in columns 10 and/or 22 between the column bottoms and the feed stages. This may be appropriate for higher feed nitrogen concentrations.

The top two sections of column 10 and condenser 18 could be replaced with a dephlegmator.

Liquid methane in line 14 from the bottom of column 10 could be further processed to recover a natural gas liquids product.

The process could be modified to recover a helium-rich stream from the overhead vapor in line 15 from column 10, where there was sufficient helium in the natural gas feed to make this economically attractive.

The process could be operated with a much higher methane content in the vent nitrogen in line 39 for possible use as a fuel stream with a consequent reduction in power consumption.

The exemplified embodiments of the invention remove nitrogen from natural gas in a dual distillation column system in which reflux liquid is provided efficiently at three temperature levels without making the process unduly complicated. The compression system is simple in comparison with many NRU processes comprising a methane product compressor with two feed streams.

This gives a process cycle with only slightly higher power consumption than the efficient cycle described in GB-B-2208699, but which is much simpler and has a significantly lower capital cost.

The refrigeration provided by the methane-rich liquid streams evaporating in condensers 26 and 18, and, if present, expander 38 is sufficient to compensate for pump work, heat leak and temperature difference at the warm end of main heat exchanger 2 and enables the product that is pumped in pump 36 to be delivered at a similar pressure to the feed with no need for further compression.

If the feed pressure reduces over a period of time, for example, due to decay of gas reservoir pressure, product that is pumped in pump 36 can still be produced at the required pressure simply by increasing the refrigeration provided by the methane-rich liquid streams evaporating in condensers 26 and 18 beyond what is required for column reflux liquid. This compensates for the reduced Joule-Thomson refrigeration that is available from the lower pressure feed. By this method, pumped product can be produced at, for example, 79 bar absolute (7.9 MPa) with the feed gas pressure as low as 25 bar absolute (2.5 MPa). Operation of the NRU is less efficient at feed gas pressures much below the required sales gas pressure, and capacity will be reduced because all of the feed gas will need to be processed in the NRU, since there can be no bypass. Also, the size of the product compressor will limit production. However, this gives the plant operator the choice of whether or not to invest in feed gas compression and certainly postpones the date at which it becomes economically viable to purchase or lease this compression system.

The problem of freezing carbon dioxide and heavy hydrocarbons is mitigated by the dual column process operating at high pressure, since the freezing components are recovered in the bottom section of the primary column 10 where the temperature is higher. The liquid from this column that is vaporized in condenser 26 does so at a sufficiently high pressure and temperature to avoid freezing. The liquid from the secondary column 22, which is vaporized at a lower temperature in condenser 18, has very low concentrations of carbon dioxide and heavy hydrocarbons such that there is no possibility of freezing in this stream. The process is tolerant to significantly higher concentrations of carbon dioxide and heavy hydrocarbons than a typical NRU double column process.

It will be appreciated that the invention is not restricted to the specific details of the embodiment described above and that numerous modifications and variations can be made without departing from the scope of the invention as defined in the following claims.

What we claim is:

1. A cryogenic process for the removal of nitrogen from a natural gas feed stream comprising nitrogen and hydrocarbons primarily having a carbon content between 1 and 8 carbon atoms comprising:

(A) feeding said feed stream to a primary distillation column of a distillation column system, said system providing a primary column methane-rich bottoms liquid from the primary column, a secondary column methane-rich bottoms liquid from a secondary distillation column fed from and operating at substantially the same pressure as the primary column, a primary column nitrogen-enriched vapor from the primary column, and a nitrogen-rich overhead vapor;

(B) reducing the pressure of and at least partially vaporizing at least a portion of the primary column methane-rich bottoms liquid in heat exchange with at least a portion of the primary column nitrogen-enriched vapor to produce a methane-rich product and to at least partially condense the primary column nitrogen-enriched vapor;

(C) returning at least a portion of the at least partially condensed primary column nitrogen-enriched vapor to the primary column to provide higher temperature reflux to the distillation column system;

(D) reducing the pressure of and at least partially vaporizing at least a portion of the secondary column methane-rich bottoms liquid in heat exchange with at least a portion of the nitrogen-rich overhead vapor to produce a further methane-rich product and to at least partially condense said nitrogen-rich overhead vapor portion; and (E) returning at least a portion of the at least partially condensed nitrogen-rich overhead vapor portion to the primary or secondary column to provide lower temperature reflux to the distillation column system.

2. The process according to claim 1, wherein:

(i) the primary column provides the primary column methane-rich bottoms liquid, the primary column nitrogen-enriched vapor, the nitrogen-rich overhead vapor, and a primary column nitrogen-enriched liquid at an intermediate location above the primary column feed;

(ii) the primary column nitrogen-enriched liquid is separated in the secondary column providing the secondary column methane-rich bottoms liquid and a secondary column nitrogen-rich overhead vapor;

(iii) the secondary column nitrogen-rich overhead vapor is fed to the primary column; and (iv) the lower temperature reflux is provided to the primary column.

3. The process according to claim 2, wherein the secondary column nitrogen-rich overhead vapor is at least partially condensed by heat exchange with at least a portion of the secondary column methane-rich bottoms liquid to provide intermediate temperature reflux to the distillation column system.

4. The process according to claim 2, wherein the secondary column nitrogen-rich overhead vapor is at least partially condensed by heat exchange with at least a portion of the primary column nitrogen-rich overhead vapor to provide intermediate temperature reflux to the distillation column system.

5. The process according to claim 1, wherein the primary column methane-rich bottoms liquid is divided into first and second portions; said first portion is recovered as a methane-rich product; and said second portion is reduced in pressure and at least partially vaporized in heat exchange with the nitrogen-enriched vapor portion.

6. The process according to claim 1, wherein:

(1) the primary column provides the primary column methane-rich bottoms liquid and the primary column nitrogen-enriched vapor;

(2) at least a portion of the primary column nitrogen-enriched vapor is separated in the secondary column providing the secondary column methane-rich bottoms liquid and the nitrogen-rich overhead vapor; and (3) the lower temperature reflux is provided to the secondary column.

7. The process according to claim 6, wherein the primary column nitrogen-enriched vapor is withdrawn as overhead from the primary column to provide the only feed to the secondary column.

8. A process according to claim 6, wherein the primary column nitrogen-enriched vapor is withdrawn from an intermediate location of the primary column and the primary column further provides a primary column nitrogen-enriched overhead vapor which also is fed to the secondary column.

9. The process according to claim 6, wherein the primary column methane-rich bottoms liquid is divided into first and second portions; said first portion is recovered as a methane-rich product; and said second portion is reduced in pressure and at least partially vaporized in heat exchange with the nitrogen-enriched vapor portion.

10. A process for the cryogenic removal of nitrogen from a natural gas feed stream comprising nitrogen and hydrocarbons primarily having a carbon content between 1 and 8 carbon atoms comprising:

(a) cooling and at least partially condensing the natural gas feed stream;

(b) reducing the pressure of the cooled and partially condensed natural gas feed stream and feeding this reduced pressure, natural gas feed stream to an intermediate location of the primary column;

(c) removing the primary column methane-rich bottoms liquid from the primary column and dividing it into first and second portions;

(d) pumping said first portion to increase its pressure, vaporizing said pumped, first portion, and recovering the vaporized, increased pressure, first portion as a first methane-rich product;

(e) subcooling and reducing the pressure of said second portion, and at least partially vaporizing the subcooled, reduced pressure second portion to produce a second methane-rich product;

(f) warming a first portion of the primary column nitrogen-rich overhead vapor to recover refrigeration;

(g) at least partially condensing a second portion of the primary column nitrogen-rich overhead vapor and returning said condensed, nitrogen-rich overhead vapor second portion to the top of the primary column to provide reflux;

(h) removing the primary column nitrogen-enriched liquid from an upper intermediate location of the primary column, and feeding said liquid to the top of the secondary column;

(i) removing and at least partially condensing the secondary column nitrogen-rich overhead vapor, and feeding said at least partially condensed secondary column nitrogen-rich vapor to an upper portion of the primary column;

(j) removing, subcooling, reducing in pressure, and vaporizing the secondary column methane-rich bottoms liquid and recovering said vaporized secondary column methane-rich bottoms liquid as a tertiary gas product;

(k) using at least a part of the refrigeration recovered in warming the primary column nitrogen-rich overhead vapor first portion of step (f) and in vaporizing the secondary column methane-rich bottoms liquid of step (j) to condense the nitrogen-rich overhead vapor second portion of step (g) to provide reflux to the top of the primary column; and (l) removing the primary column nitrogen-enriched vapor from an intermediate location of the primary column between the feed point of step (b) and the upper intermediate location of step (h) and at least partially condensing the primary column nitrogen-enriched vapor by heat exchange against the subcooled, reduced pressure second portion of the primary column methane-rich bottoms liquid to provide higher temperature reflux.

11. The process according to claim 10, wherein the primary and secondary columns are reboiled by heat exchange with the natural gas feed stream.

12. The process according to claim 10, wherein a further nitrogen-enriched vapor from an upper location of the primary column is condensed and returned to the primary column as an intermediate temperature reflux.

13. The process according to claim 10, wherein the natural gas feed stream is divided into first and second portions; said first portion is reduced in pressure and then fed to an intermediate location of the primary column; and said second portion is reduced in pressure, partially vaporized and then fed to the primary column at a location below the feed point of the first feed portion.

14. The process according to claim 10, wherein the primary column operates at 2 to 2.8 MPa (20 to 28 bar absolute).

15. An apparatus for the cryogenic removal of nitrogen from a natural gas feed stream comprising nitrogen and hydrocarbons primarily having a carbon content between 1 and 8 carbon atoms, the apparatus comprising:

a distillation system having a primary distillation column and a secondary distillation column fed from and operating at substantially the same pressure as the primary column, said system providing a primary column methane-rich bottoms liquid from the primary column, a secondary column methane-rich bottoms liquid from the secondary distillation column, a primary column nitrogen-enriched vapor, and a nitrogen-rich overhead vapor;

means for feeding the feed stream to the primary column, means for reducing the pressure of at least a portion of the primary column methane-rich bottoms liquid;

heat exchange means for at least partially vaporizing said reduced pressure primary column methane-rich bottoms liquid portion with at least a portion of the primary column nitrogen-enriched vapor to produce a methane-rich product and to at least partially condense the primary column nitrogen-enriched vapor;

means for returning at least a portion of the at least partially condensed primary column nitrogen-enriched vapor to the primary column to provide higher temperature reflux to the distillation column system;

means for reducing the pressure of at least a portion of the secondary column methane-rich bottoms liquid;

means for at least partially vaporizing said reduced pressure secondary column methane-rich bottoms liquid portion with at least a portion of the nitrogen-rich overhead vapor to produce a further methane-rich product and to at least partially condense the nitrogen-rich overhead vapor portion; and means for returning at least a portion of the at least partially condensed nitrogen-rich overhead vapor portion to the primary or secondary column to provide lower temperature reflux to the distillation column system.

16. The apparatus according to claim 15, wherein the primary column provides the primary column methane-rich bottoms liquid, the primary column nitrogen-enriched vapor, the nitrogen-rich overhead vapor, and a primary column nitrogen-enriched liquid at an intermediate location above the primary column feed; the means for returning at least a portion of the at least partially condensed nitrogen-rich overhead vapor portion returns said portion to the primary column; and the apparatus further comprises:

means for feeding the primary column nitrogen-enriched liquid for separation in the secondary column providing the secondary column methane-rich bottoms liquid and a secondary column nitrogen-rich overhead vapor; and means for feeding the secondary column nitrogen-rich overhead vapor to the primary column.

17. The apparatus according to claim 16, comprising means for at least partially condensing the secondary column nitrogen-rich overhead vapor prior to feeding to the primary column by heat exchange with at least a portion of the secondary column methane-rich bottoms liquid.

18. The apparatus according to claim 16, comprising means for at least partially condensing the secondary column nitrogen-rich overhead vapor prior to feeding to the primary column by heat exchange with at least a portion of the nitrogen-rich overhead vapor from the primary column.

19. The apparatus according to claim 15, further comprising means for dividing the primary column methane-rich bottoms liquid into first and second portions; means for recovering said first portion as a methane-rich product; means for reducing the pressure of said second portion; and heat exchange means for at least partially vaporizing the reduced pressure portion in heat exchange with the nitrogen-enriched vapor portion.

20. The apparatus according to claim 15, wherein the primary column provides the primary column methane-rich bottoms liquid and the primary column nitrogen-enriched vapor; the means for returning at least a portion of the at least partially condensed nitrogen-rich overhead vapor portion returns said portion to the secondary column; and the apparatus further comprises means for feeding at least a portion of the primary column nitrogen-enriched vapor for separation in the secondary column providing the secondary column methane-rich bottoms liquid and the nitrogen-rich overhead vapor.

21. The apparatus according to claim 20, wherein the primary column nitrogen-enriched vapor is withdrawn as overhead from the primary column to provide the only feed to the secondary column.

22. The apparatus according to claim 20, wherein the primary column nitrogen-enriched vapor is withdrawn from an intermediate location of the primary column and the primary column further provides a primary column nitrogen-enriched overhead vapor and the apparatus further comprises means for feeding said overhead vapor to the secondary column.

23. An apparatus for the cryogenic removal of nitrogen from a natural gas feed stream comprising nitrogen and hydrocarbons primarily having a carbon content between 1 and 8 carbon atoms, the apparatus comprising:

means for cooling and at least partially condensing the natural gas feed stream;

means for reducing the pressure of the natural gas feed stream and feeding this reduced pressure, natural gas feed stream to an intermediate location of the primary column;

means for dividing the primary column methane-rich bottoms liquid into first and second portions;

means for pumping said first portion to increase its pressure, vaporizing the pumped, first portion to provide a first methane-rich product;

means for subcooling said second portion;

means for reducing the pressure of said subcooled second portion;

means for at least partially vaporizing the subcooled, reduced pressure second portion to provide a second methane-rich product;

means for warming at least a portion of a first portion of nitrogen-rich overhead vapor from the primary column to recover refrigeration;

means for at least partially condensing a second portion of the nitrogen-rich overhead vapor from the primary column;

means for returning said condensed, nitrogen-rich overhead vapor second portion to the top of the primary column to provide reflux;

means for removing the primary column nitrogen-enriched liquid from an upper intermediate location of the primary column, and feeding said liquid to the top of the secondary column;

means for at least partially condensing the secondary column nitrogen-rich overhead vapor;

means for feeding said at least partially condensed secondary column nitrogen-rich vapor to an upper portion of the primary column;

means for subcooling the secondary column methane-rich bottoms liquid;

means for reducing the pressure of said subcooled secondary bottoms liquid;

means for vaporizing the reduced pressure secondary column bottoms liquid to provide a tertiary gas product;

means for using at least a part of the refrigeration recovered in warming the primary column nitrogen-rich overhead vapor first portion of step (f) and in vaporizing the secondary column methane-rich bottoms liquid of step (j) to condense the nitrogen-rich overhead vapor second portion of step (g) to provide reflux to the top of the primary column;

means for removing the primary column nitrogen-enriched vapor from an intermediate location of the primary column between the feed point of the reduced pressure natural gas and the removal of the primary column nitrogen-enriched liquid; and means for at least partially condensing the primary column nitrogen-enriched vapor by heat exchange against the subcooled, reduced pressure second portion of the primary column methane-rich bottoms liquid to provide higher temperature reflux.

24. The apparatus according to claim 23, further comprising means for reboiling the primary and secondary columns by heat exchange with the natural gas feed stream.

25. The apparatus according to claim 23, further comprising means for removing and condensing a further nitrogen-enriched vapor from an upper location of the primary column and returning said condensed vapor to the primary column as an intermediate temperature reflux.

26. The apparatus according to claim 23, further comprising means for dividing the natural gas feed stream into first and second portions; means for reducing the pressure of said first portion and then feeding it to an intermediate location of the primary column; means for reducing the pressure of said second portion; and means for partially vaporizing said second portion and then feeding it to the primary column at a location below the feed point of the first feed portion.

* * * * *